US010117803B2

(12) United States Patent
Fadil et al.

(10) Patent No.: US 10,117,803 B2
(45) Date of Patent: Nov. 6, 2018

(54) MASSAGE SYSTEM

(71) Applicant: Phlex Therapeutics, Inc., Palo Alto, CA (US)

(72) Inventors: Mark A. Fadil, Palo Alto, CA (US); Jonathan Edelman, Palo Alto, CA (US)

(73) Assignee: Phlex Therapeutics, Inc., Palo Alto, CA (US)

( * ) Notice: Subject to any disclaimer, the term of this patent is extended or adjusted under 35 U.S.C. 154(b) by 442 days.

(21) Appl. No.: 14/539,931

(22) Filed: Nov. 12, 2014

(65) Prior Publication Data

US 2015/0133835 A1 May 14, 2015

Related U.S. Application Data

(60) Provisional application No. 61/903,331, filed on Nov. 12, 2013.

(51) Int. Cl.
*A61H 15/00* (2006.01)
*A61H 7/00* (2006.01)

(52) U.S. Cl.
CPC ..... *A61H 15/0092* (2013.01); *A61H 7/00* (2013.01); *A61H 7/001* (2013.01); *A61H 7/002* (2013.01); *A61H 7/003* (2013.01); *A61H 7/007* (2013.01); *A61H 15/00* (2013.01); *A61H 2015/0014* (2013.01); *A61H 2015/0021* (2013.01); *A61H 2201/0107* (2013.01); *A61H 2201/1253* (2013.01); *A61H 2201/1284* (2013.01); *A61H 2201/1695* (2013.01); *A61H 2205/081* (2013.01)

(58) Field of Classification Search
CPC ..... A61H 7/00; A61H 7/002; A61H 7/003; A61H 15/00; A61H 15/0092; A61H 2015/0007; A61H 2015/0014; A61H 2015/0021; A61H 2015/0028; A61H 2015/0035; A61H 2015/0042; A61H 2015/005; A61H 7/001; A61H 7/007; A61H 2007/009
USPC ..... 601/99, 112, 115, 118, 119, 120, 121, 601/129, 131, 134, 135
See application file for complete search history.

(56) References Cited

U.S. PATENT DOCUMENTS 3,672,358 A * 6/1972 Majewski ..... A61H 15/0092 601/132
3,750,654 A * 8/1973 Shiu ..... A61H 15/00 601/121
5,488,755 A * 2/1996 Chang ..... A63B 23/16 16/430
6,200,283 B1 * 3/2001 Groen ..... A61H 15/00 601/121
6,974,427 B1 * 12/2005 Lapham ..... A61H 15/00 601/120

(Continued)

*Primary Examiner* — Colin W Stuart
(74) *Attorney, Agent, or Firm* — McCoy Russell LLP

(57) ABSTRACT

A system is provided for a three-part self-massage system including three massage devices configured to be removably coupled and assembled inside one another. Additionally, the three massage devices may include zones of varying densities of foam and shaped to include contours and projections including nodules, knobs, bumps, grooves, and/or ridges, such that the massage devices may be used for varying massage techniques. In this way, the three massage devices may be combined into one compact unit for easier storage and transport.

16 Claims, 7 Drawing Sheets

(56) References Cited

U.S. PATENT DOCUMENTS

| | | | | |
|---|---|---|---|---|
| 7,361,153 | B1 * | 4/2008 | Martin | A61H 7/001 601/135 |
| 2008/0200851 | A1 * | 8/2008 | Faussett | A61H 15/0092 601/119 |
| 2009/0112137 | A1 * | 4/2009 | Lamore | A63B 21/0004 601/112 |
| 2011/0077665 | A1 * | 3/2011 | Tittas | A45D 26/0061 606/133 |
| 2012/0065557 | A1 * | 3/2012 | Phillips | A61H 15/0092 601/99 |
| 2014/0128786 | A1 * | 5/2014 | Ross | A61H 15/0092 601/118 |

* cited by examiner

MASSAGE SYSTEM

CROSS REFERENCE TO RELATED APPLICATION

The present application claims priority to U.S. Provisional Patent Application No. 61/903,331, entitled, "MASSAGE SYSTEM," filed on Nov. 12, 2013, the entire contents of which are hereby incorporated by reference for all purposes.

FIELD OF INVENTION

The present application relates to a massage system.

BACKGROUND AND SUMMARY

Massage is used to treat sore and stiff muscles of the body through various techniques such as deep tissue, myofascial release, and trigger point massage. These massage techniques focus on target tissues including muscles, tendons, ligaments, fascia, skin, and joints in order to eliminate pain and increase range of motion. Athletes and exercisers commonly use massage to improve performance, reduce muscle soreness, and recover from injury. Massage may also be used to treat non-exercise related pain and dysfunction such as chronic low back and neck pain. In order to receive massage treatment, a person is usually seen by a trained massage therapist. However, repetitive visits to a massage therapist may become costly for many individuals. More recently, mechanical massage devices have become popular amongst massage therapists, athletes, and exercisers. Some mechanical massage devices include foam rollers and massage sticks. As such, the mechanical massage devices allow for a person to engage in massage treatment outside of the therapist's office.

The inventors have recognized a problem with mechanical massage devices such as foam rollers and massage sticks. Such devices may be designed for a specific massage technique and therefore may not treat an array of muscle problems. For example, different foam rollers may have different specific foam densities (e.g. high or low density foam rollers may be needed to treat different muscle groups or areas). Further, some foam rollers may also include bumps or grooves while others do not. For example, a high density foam roller may be used for myofascial release, whereas a grooved foam roller may be used for trigger point massage.

The above issues may be at least partially addressed by a massage system comprising a first massage device removably coupled to a second massage device, and a second massage device removably coupled to a third massage device. The second and third massage devices may be disposed within a bore of the first massage device. Therefore, in an example, the second device and third device may have a common central longitudinal axis when coupled with the first device. In this way, the first, second, and third massage devices may be combined into one compact unit for ease in storage and transport.

In one embodiment, a massage system may be provided, comprising one or more massage devices that may be removably coupled to one another. For example, a first massage device may include a foam roller with plurality of ridges and may have a hollow inner cylinder formed by an inner wall of the foam roller. A second massage device may comprise asymmetric projections with different radial projects about a central axis. In addition, a third massage device may comprise a solid undulating rod. Providing such a massage system allows a user to self-administer a variety of massage techniques (e.g. myofascial release, deep tissue, and trigger point massage).

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 4A:
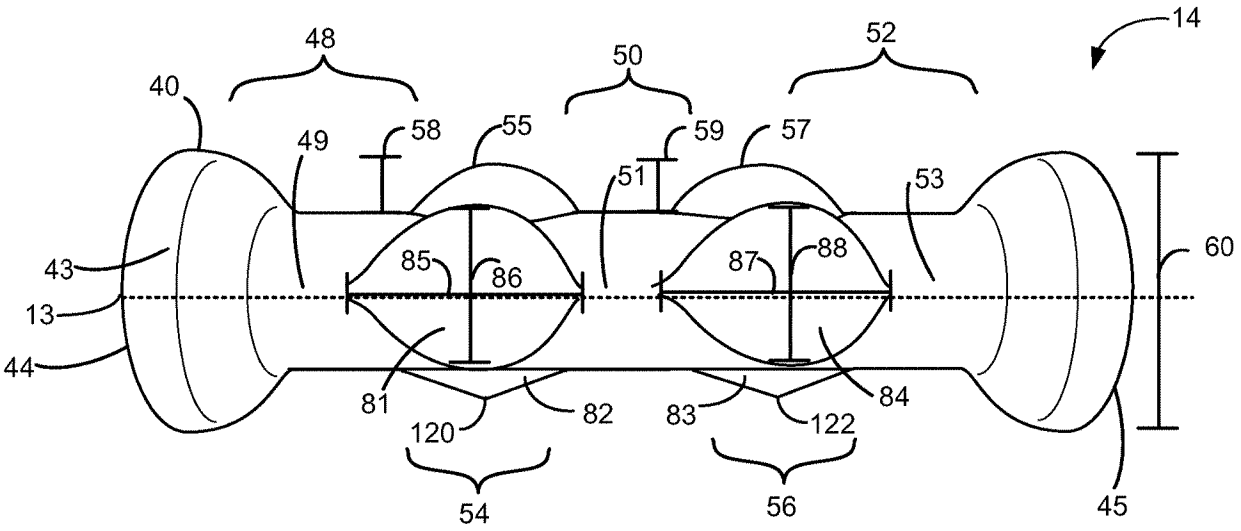
FIGS. 4A-B shows a schematic illustration of a second massage device.
Figure 4B:
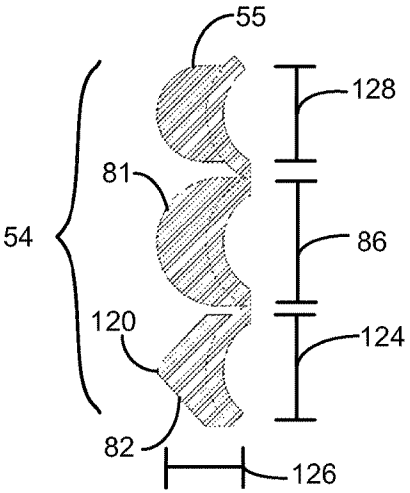
Figure 5A:
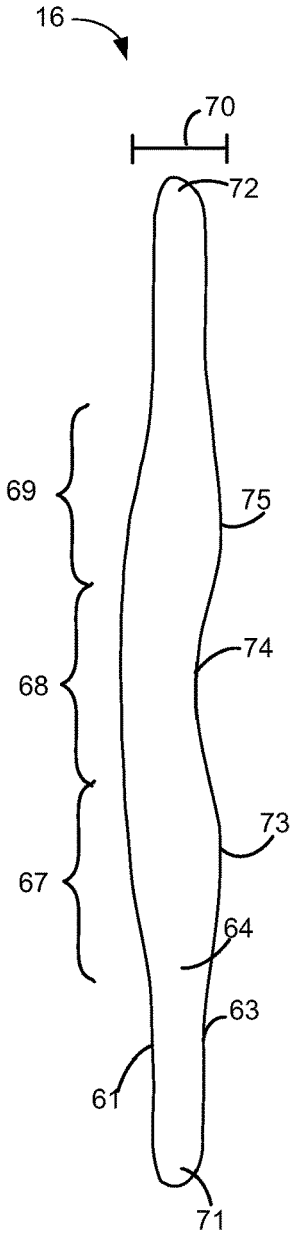
FIGS. 5A-C shows a schematic illustration of a third massage device.
Figure 5B:
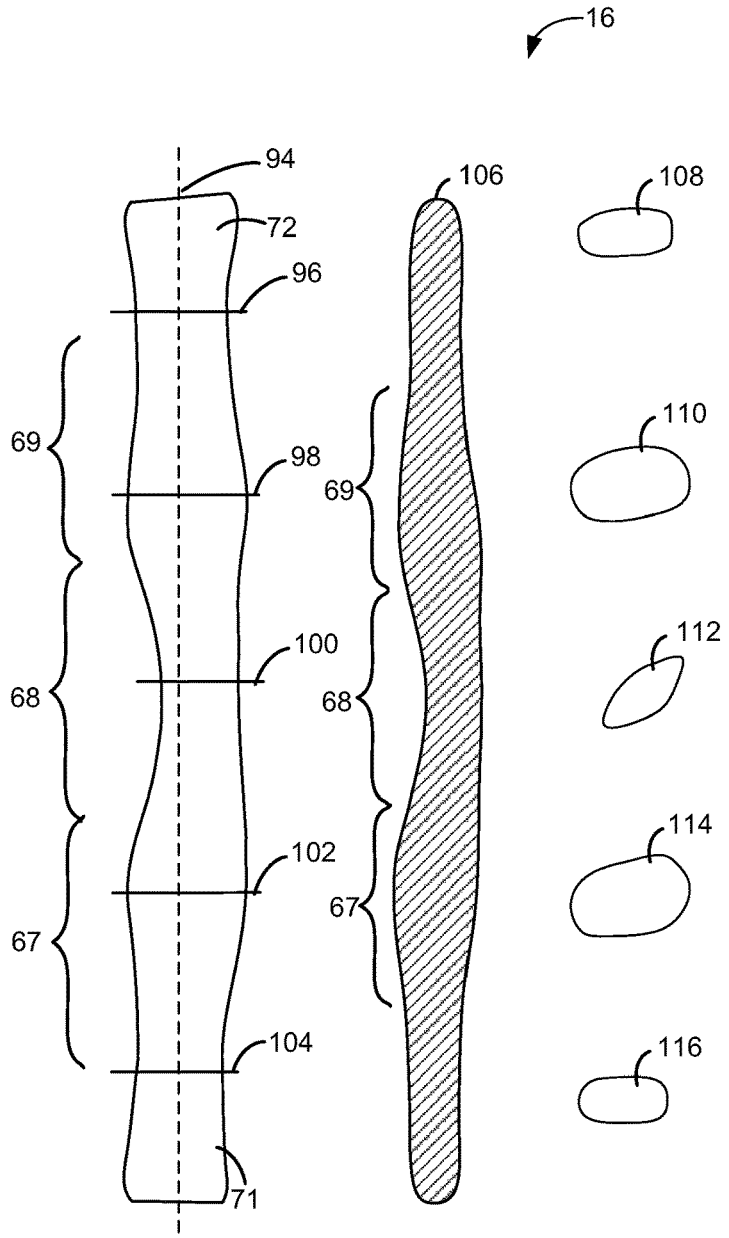
Figure 5C:
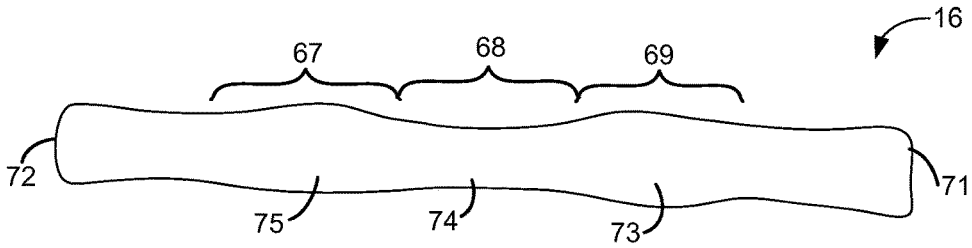
Figure 6A:
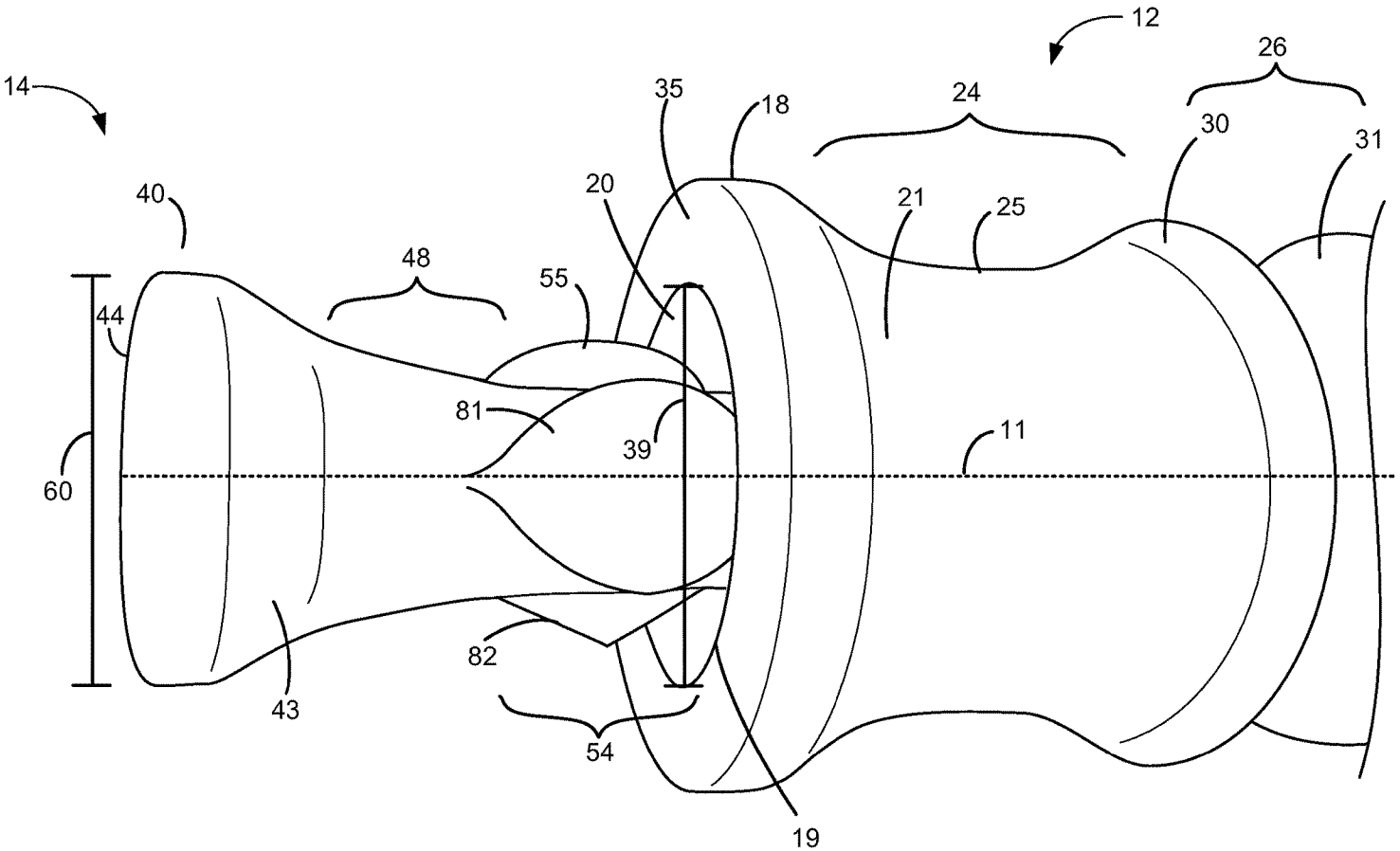
FIGS. 6A-B a schematic illustration of a three-part self-massage system including a partial assembly with two massage devices and a partial assembly with three massage devices.
Figure 6B:
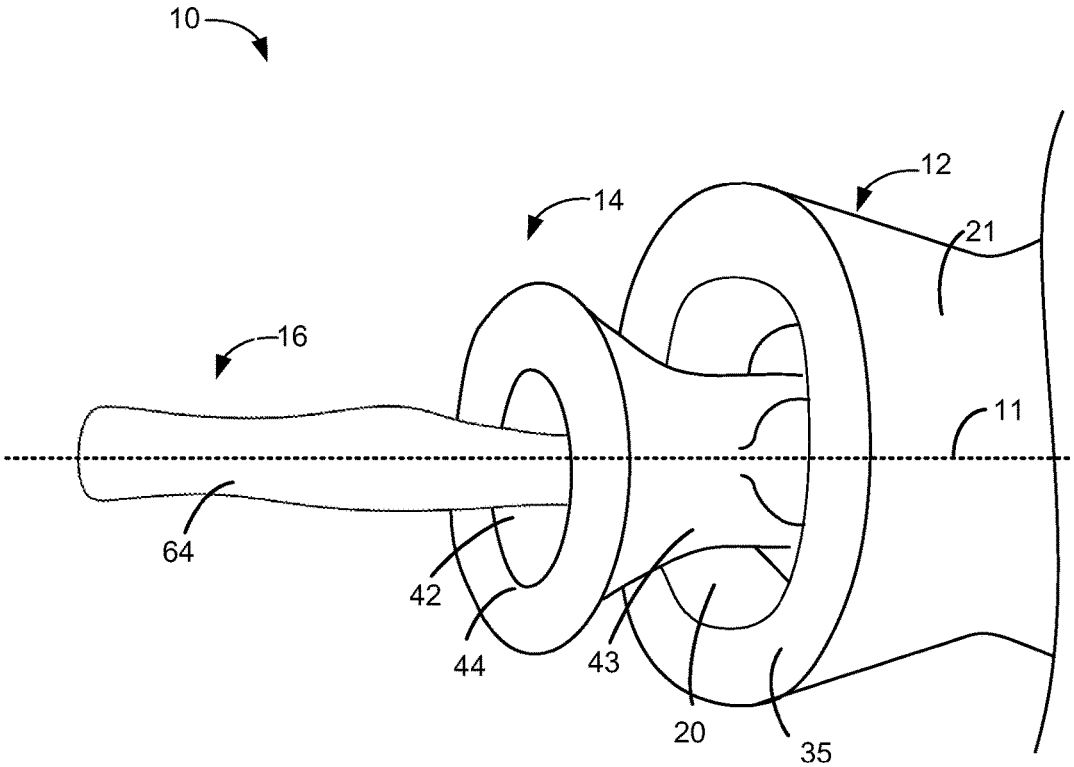

A system is provided for a three-part self-massage system including three massage devices configured to be removably coupled and assembled inside one another (FIGS. 1A-F and FIGS. 2A-B). Additionally, the three massage devices may include contours and projections including nodules, knobs, bumps, grooves, and/or ridges in order to enable self-administered massaging techniques. Furthermore, the massage devices may include "zones" of high and/or low density foam material. In at least one of the massage devices, the foam roller may have a plurality of zones of varying densities of foam as well as projections that mimic the contour of the user's spine, such as the device shown in FIG. 3. A second massage device may include zones having a plurality of projections having various geometric shapes that may be formed from varying densities of foam, as shown in FIGS. 4A-B. In addition, the massage system may include a massage device having a stick or rod shape that does not contain projections, but, rather, one or more contours, as illustrated in FIGS. 5A-C. The three massage devices, including the varying densities of foam and the plurality of projections, may allow a user to self-administer several massage techniques (e.g. myofascial release, deep tissue, and trigger point massage) using a single massage system that is easily transported and stored. Since the separate massage devices are removably coupled to one another, one or more massage devices may be constructed and formed in a way that enables the aforementioned device(s) to fit in the bore of at least one of the other massage devices, as illustrated in FIGS. 6A-B. In this way, the three massage devices may be combined into one compact unit for ease in storage and transport.

Figures 1A, 1B, 1C, 1D, 1E, 1F:
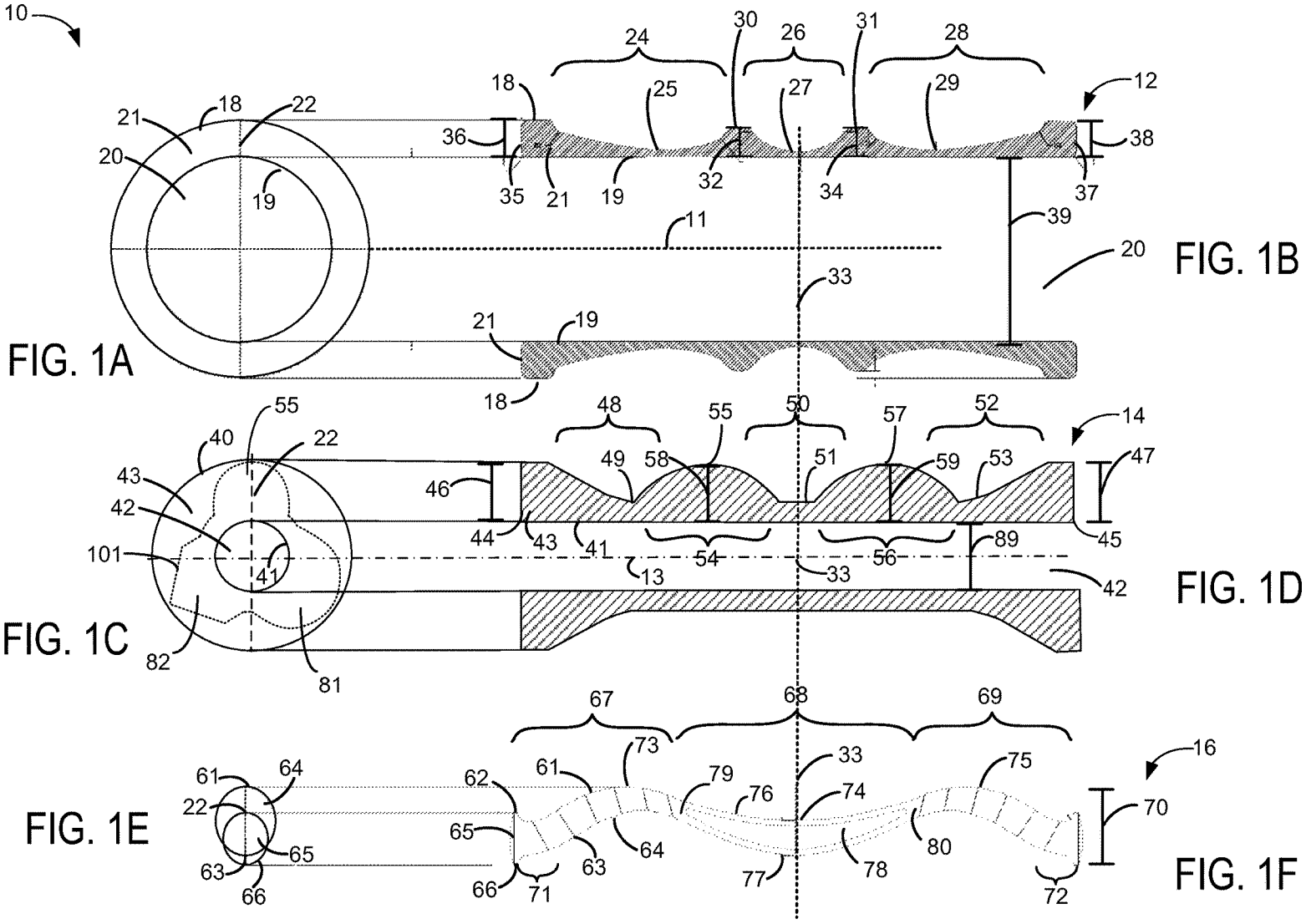
FIGS. 1A-F shows a schematic illustration of a three-part self-massage system including three separate massage devices.

Referring now to FIGS. 1A-F, a schematic diagram of a three-part self-massage system, including three separate massage devices, is shown. The three-part self-massage system may include three annular-shaped massage devices including two foam roller devices and a solid rod device. Since massage techniques (e.g., myofascial release, deep tissue, and trigger point) may involve applying shear compression and/or tension to muscles in various directions, or by skin rolling, the three massage devices may be formed and/or shaped in order to perform a variety of specific massage techniques coupled with the ability to fit one massage device in another massage device. Herein, three-part self-massage system is one example of a massage system, wherein other examples may include a single device Massage device 10 may be shaped in order to provide a variety of massage techniques to muscle and joints. Referring now to FIGS. 1A-B, the first massage device of massage device 12 is shown. A first massage device 12 may be formed such that the device may provide a deep tissue massage technique, for example, as a foam roller. As such, the first massage device may be cylindrical and may include a hard hollow spine. In one example, the hard hollow spine may be formed from greater density foam as compared to the foam used to form the body and/or outer surface of the massage device. As shown in FIG. 1A, the first massage device 12 may be cylindrical with a body 21 defined by an outer surface 18, inner surface 19, and bore 20. In one embodiment, the outer surface 18 of the massage device body 21 may include a plurality of vertically extending projections or ridges. In one example, projections or ridges are parallel. As such, outer surface 18 may be an uneven surface. In one example, inner surface 19 and bore 20 may form a hard hollow spine. Specifically, inner surface 19 may be comprised of a hard ABS plastic. Additionally, the first massage device 12 may be formed from high density foam. In one example, the high density foam may be composed of a closed cell foam. The cutting plane 22 defines the end view shown in FIG. 1B.

Referring now to FIG. 1B, an end-view of a first massage device 12 is shown, as described above with regard to FIG. 1A. The first massage device 12 includes a massage device body 21 and bore 20. The bore 20 may extend longitudinally along a common longitudinal central axis 11 for the entire length of the body 21. In one example, the bore may be a hollow center along the central axis. Further, bore 20 may have a diameter of distance 39 such that a second massage device 14 may be disposed in bore 20 of the first massage device 12.

The body 21 of the massage device 12 may include an outer surface 18 and an inner surface 19. In one embodiment, the outer surface 18 of the massage device body 21 may include a plurality of vertically extending projections or ridges having a specific vertical height relative to the central axis 11, as described below with regard to FIG. 1B. In contrast, inner surface 19 may not contain projections and thus may have a level and/or smooth surface.

In one example, the body 21 of the massage device 12 may be formed of non-uniform hard density foam along longitudinal central axis 11, such that the massage device body may be divided into one or more zones based on the varying foam density. In this example, body 21 of a massage device 12 may have at least three zones including zone 24, zone 26, and zone 28, wherein each zone may comprise the same or varying densities of foam. For example, zone 24 may be formed with low density foam as compared to the density of the foam in zone 28. As a result, the varying densities of foam may allow the user to have more control over the pressure applied to the muscle and/or soft tissue, thereby increasing effectiveness of the massage.

Additionally, the body 21 may also include inner ridges and/or contours that may be parallel about the longitudinal central axis 11. The body 21 may be shaped such that the zones include contours circumferentially around the outer surface. Specifically, the body 21 including zone 24 and zone 28 may have a contour 25 and contour 29, respectively. Contour 25 and contour 29 may be a concave shape, such as a ridge, arranged annularly around the body 21. In one example, contour 25 and contour 29 may be u-shaped contours. In another example, contours 25 and 29 may be a groove, indent, ridge and/or valley of varying shapes or geometries. In one embodiment, the longitudinal distances of zone 24 and zone 28 may be the same length.

As described in reference to FIG. 1B, the zones may be defined based on the position of a plurality of parallel projections and/or ridges. In one example, the plurality of projections may be a plurality of ridge-shaped projects circumferentially around an outer surface of the first device. Furthermore, the massage device body may be shaped such that at least three zones include annularly arranged contours. In this example, zone 26 may be located between projection 30 and projection 31. Projection 30 and 31 may be formed as a ridge with rounded edges. In addition, projection 30 may be arranged parallel to projection 31 such that the projections form a contour 27 therebetween with a longitudinal distance. In one example, the contour 27 may be a groove, indent, or valley. In another example, the contour may be u-shaped. Additionally, the longitudinal distance of contour 27 may be smaller than the longitudinal distance of contours 25 and 29. In one example, projections 30 and 31 may extend outwardly at a distance from the vertical axis 33. In an example, projections 30 and 31 may also extend vertically from the massage device body. For example, projection 30 may extend at a distance of vertical distance 32, and projection 31 may extend at a distance of vertical distance 34, wherein both vertical distances 32 and 34 are substantially the same such that both projections have the same vertical height. Further, the projections may be arranged annularly around the outer surface 18 of the massage device body 21. The projections (e.g., projection 30 and projection 31) may also be disposed perpendicular to the massage device body 21. In this way, the raised parallel projections in zone 26 may be formed such that the projections and/or ridges engage with contours of the musculature surrounding the human spine. Consequently, the projections may penetrate deep into the paraspinal muscles, as well as any muscles and soft tissue that require a deeper massage.

In another example, zone 24 and zone 28 may have an outer edge 35 and outer edge 37, respectively. Based on the shape of the contours of zone 24 and zone 28, the outer edge 35 and outer edge 37 may also form a first and second outer edge projection, respectively. As such, outer edge 35 has a vertical distance 36 and outer edge 37 has a vertical distance 38. In one example, vertical distance 36 and vertical distance 38 may have the same vertical height. In another example, vertical distance 36 and vertical distance 38 may be larger than vertical distance 32 and vertical distance 34.

The outer edges 35 and 37 may also be formed such that the outer edges may have a flat surface. As such, the outer edge 35 and 37 may extend more vertical than projections 30 and 31. In another example, the projections 30 and 31 may be formed such that the projections include rounded edges as compared to the flat edges of outer edge 35 and 37. In another example, the outer edges 35 and 37 may be arranged annularly around the outer surface of the massage device body. In this way, the outer edges 35 and 37 provide a distinct surface to make contact with the ground. Specifically, zone 24, zone 26, and zone 28 may be molded such that they do not make contact with the ground. Projection 30 and projection 31, for example, may be molded such that the projections only make contact with the user (e.g. the user's body). Therefore, outer edges 35 and 37 may be the only part of the roller or massage device 12 that makes contact with the ground. Therefore, the arrangement of the outer edges may prolong the lifespan and durability of the roller. In this way, zone 24, zone 26, zone 28, projection 30, and projection 31 may provide for distinct surfaces that make contact with the body for administering deep tissue massage.

Now referring to FIG. 1C-D, a second massage device 14, such as a second massage roller, may be formed such that the device may provide a trigger point massage technique. As such, the second massage device 14 may be cylindrical and may include a hard hollow spine. A second massage device body 43 may be formed from high density foam such as closed cell foam. As shown in FIG. 1C, the second massage device 14 may be cylindrical with body 43 defined by an outer surface 40, an inner surface 41, and a bore 42. In one example, inner surface 41 and bore 42 may form a hard hollow spine that is enveloped with high density foam of the massage device body 43. Specifically, inner surface 41 may be comprised of a hard ABS plastic.

In addition, the second massage device 14 may comprise of asymmetric projections with different radial projections about the central axis. For example, a dashed outline 101 shows an example shape of a plurality of projections, discussed below, in a side view of the second massage device 14 if unobstructed by outer edges 44 and 45. The plurality of projections may be formed with varying lengths and widths, such that one or more projections have unequal surface areas. For example, projection 55 and projection 81 may generally comprise a similar shape, that is, an annular knob, while projection 82 may comprise a triangular or pyramidal shape. The cutting plane 22 defines the cross-section shown in FIG. 1D.

Referring now to FIG. 1D, an end-view of a second massage device 14 is shown, as described above with regard to FIG. 1C. The second massage device 14 includes a massage device body 43, and bore 42. The bore 42 may extend longitudinally along longitudinal axis 13 for the entire length of the body 43. Longitudinal axis 13 may be the substantially the same as the common longitudinal axis 11 when the second massage device 14 is coupled to the first massage device 12. Further, bore 42 may have a vertical distance 89 such that a third massage device 16 may be disposed in bore 42 of the second massage device 14. Also, the second massage device 14 may have a vertical distance such that the second massage device 14 may be positioned in bore 20 of the first massage device 12. The body 43 of the second massage device may include an outer surface 40 and an inner surface 41.

In an embodiment, the outer surface of the massage device body may include a plurality of vertically extending projections. The plurality of vertically extending projections may be annular and/or pyramidal in shape and may vary in size. For example, a first projection of the second massage device 14 may be rounded as compared to a second projection of the second device which may be more pointed than rounded. In another embodiment, the plurality of vertically extending projections may have another geometric shape. Furthermore, the projections may be arranged circumferentially about the body 43 of massage device 16 at substantially similar distances and angles from one another. In one example, the angle between each projection, as seen in the side view shown in FIG. 1C, may be substantially 120 degrees such that each projection is spaced about evenly from an adjacent projection about the second massage device 14. In contrast, the inner surface 41 may not contain projections and may have a level surface.

Said another way, the projections, as shown in dashed outline 101, may have different cross-sectional profiles from an end-view of the central axis 13 with at least a first projection having a rounded exterior peak (e.g., projection 55) and at least another second projection having a more pointed exterior peak (e.g., projection 82). In addition, in another example, the projections may be at different angular positions around the central axis 13. The projections may also include a third projection, such as projection 81, having a wider, in terms of an angle about the central axis, and longer, along longitudinal axis 13, annular peak than the first projection (e.g., projection 55). In another example, the first, second, and third peaks may be 120 degrees apart from one another around the central axis. There may be a total of exactly five of said projections with all five of said projections spaced away from each of two ends of the foam roller, the more pointed exterior peak being in a middle area of the foam roller.

The body 43 of the massage device 14 may be formed of uniform hard density foam. Additionally, the body 43 may be divided into zones based on the position of the plurality of projections. For example, body 43 may have at least five zones including zone 48, zone 50, zone 52, zone 54, and zone 56. Zone 48, zone 50, and zone 52 may be formed with uniform density foam such as closed cell foam. Zone 54 and zone 56 may include annular and/or pyramidal projections arranged circumferentially about the outer surface, wherein the projections may be of various sizes, as shown in the side view of FIG. 1C. Additionally, the massage device body may be shaped such that at least two zones include annularly arranged contours and/or ridges having rounded and/or more pointed than rounded shapes.

In one example, the contours may be asymmetric along a central axis of the foam roller. Specifically, the body 43 including zone 48, zone 50, and zone 52 may have a contour 49, contour 51, and contour 53, respectively. In one example, contour 49, contour 51, and contour 53 may be u-shaped concave portions arranged symmetrically around the central axis 13. In another example, contour 49, contour 51, and contour 53 may be a groove, indent, or valley of varying shapes. In yet another example, the longitudinal distances of zone 48, zone 50, and zone 52 may be different lengths. The longitudinal distances of zone 48, 50, and/or 52 may be less than the longitudinal distance of zone 24 and 28 of massage device 12. Furthermore, the radius of the curvature of contours 49, 51, and 53 may be less than the radius of the curvature of contours 25 and 29.

In addition, the massage device zones may be formed based on the position of a plurality of projections. In one example, the projections may be ridges formed such that the ridges are asymmetric around a central axis and are formed via convex portions. In an embodiment, at least two of the zones contain at least three annularly arranged projections in each zone. For example, massage device 14 may have a zone 54 and zone 56 including projections 55 and 57, respectively. Specifically, in the cross-sectional view of FIG. 1D, only one projection per zone is shown. As such, zone 54 and zone 56 may include three annularly arranged projections, as described further with regard to FIG. 4. In this example, projection 55 and projection 57 may be shaped as annular knobs. The knob-shaped projections may be of various sizes. In another example, the projections may include one or more triangular or pyramidal-shaped projections, ridges and/or bumps. For example, a first projection of the second massage device 14 may be rounded as compared to a second projection of the second device which may be more pointed than rounded. Furthermore, each of a projection in each particular zone may be different from one or more projections in the same zone. For example, in zone 54, a first projection may be an annular knob, a second projection may be a larger annular knob than the first projection, and a third projection may by a generally pyramidal-shaped projection. Indeed, the third projection may be more pointed than rounded as compared to the first and second projection.

Whereas the projections 30 and 31 of massage device 12 may be shaped such that projections 30 and/or 31 form a continuous ridge and/or projection, the projections of massage device 14 may not be continuous and may include a ridge and/or space between each projection. For example, projection 55 may be one projection of the three projections included in zone 54. As such, projection 55 and another projection may have a ridge and/or space between them, as described further with regard to FIG. 4. In one example, the zones may be separated by parallel ridges. Based on the vertical and longitudinal distances of the three projections of zone 54 and/or zone 56, the total surface area of the projections may be greater than the surface area of projections 30 and/or 31.

Further, the projections may be formed from non-uniform density foam. For example, at least one projection in a zone may be formed from higher density foam as compared to at least one other projection in that zone. In another example, at least one projection in a zone may be lower density foam than at least one other projection in that zone. Additionally, a projection in a first zone may be formed from the same density foam as a corresponding projection in a second zone. For example, projection 55 may be parallel to projection 57. Thus, projection 55 may be formed with the same high density foam as projection 57. However, another projection in zone 54 (not shown) may have a different density as projection 55. In this way, the varying densities of foam may allow for maximum penetration of the projections into muscle and soft tissue, thereby enhancing the trigger point massage technique.

The massage device body may be shaped such that three zones include annularly arranged contours. The contours may be formed based on the position of the projections in zone 54 and zone 56, as well as the outer edge of the massage device. For example, projection 55 may be arranged parallel to projection 57 such that the projections form a contour 51 of zone 50. In one example, the contour may be a groove, indent, or valley. Additionally, the groove, indent or valley may slope at a specific angle that ends immediately before the elevated surface(s) of the projection. Alternatively, the contour may be u-shaped or flat. The longitudinal distance of contour 51 may be of a different length than the longitudinal distance of contour 49 and/or longitudinal distance of contour 53.

Projection 55 and projection 57 may also extend vertically from the massage device body. For example, projection 55 and projection 57 may extend a vertical distance 58 and vertical distance 59. The vertical distances 58 and 59 of the projections 55 and 57, respectively, may have equal vertical lengths. However, in other embodiments, the vertical distances of the projections may have different lengths. Further, the projections may be arranged annularly around the outer surface of the massage device body 43. In another example, the projections may be disposed perpendicular to the massage device body.

In addition, an outer edge of the massage device, such as an outer edge 44 and an outer edge 45, may include a projection that may be arranged annularly around the outer surface of the massage device body. For example, zone 48 and zone 52 may have an outer edge 44 and outer edge 45, respectively. In an embodiment, based on the shape of the contours of zone 48 and zone 52, the outer edge 44 and outer edge 45 may also form one or more outer edge projections. As such, the outer edge 44 has a vertical distance 46 and outer edge 45 has a vertical distance 47. In one example, vertical distance 46 and vertical distance 47 may have equal vertical heights. In another example, vertical distance 46 and vertical distance 47 may greater than the vertical distance 58 and vertical distance 59. In another example, outer edges 44 and 45 may be positioned parallel to projections 55 and 57. Thus, outer edges 44 and 45 may be disposed perpendicular to zones 48 and 52.

In another embodiment, the outer edges 44 and 45 provide a distinct surface to make contact with the ground. Specifically, zone 48, zone 50, zone 52, zone 54, and zone 56 may be molded such that they do not make contact with the ground and may be molded such that the projections only make contact with the user (e.g. the user's body). In this way, outer edges 44 and 45 may be the only part of the roller that makes contact with the ground. In this way, zone 48, zone 50, zone 54, zone 56, and zone 58 may provide for a distinct surface that makes contact with the body for administering the trigger point massage. Therefore, the arrangement of the outer edges may prolong the lifespan and durability of the roller.

Now referring to FIG. 1E-F, a third massage device 16 may be included for applying a massage technique, such as a myofascial release massage technique. As such, the third massage device 16 may include a solid undulating rod that has been shaped with a concave and a convex working surface for at least along a partial length of said device 16. In one example, the solid undulating rod may be formed from hard plastic. In another example, the undulating solid rod may be formed from uniform density foam. Moreover, the third massage device 16 may include two ergonomically shaped handles at each end of device 16, such as handle 71 and handle 72. As shown in FIG. 1E-F, the third massage device 16 may be generally cylindrical in shape with a body 64 defined by a top surface 61, bottom surface 63, and a handle body 65. The cutting plane 22 defines the cross-section shown in FIG. 1F.

Referring now to FIG. 1F, an edge view of a third massage device 16 is shown, as described above with regard to FIG. 1E. Third massage device 16 may be undulating and cylindrical with a body 64 defined by a top surface 61, bottom surface 63, and handles 71 and 72. Further, handles 71 and 72 may include a top surface 62, bottom surface 66 and body 65. The massage device body 64 of the third device 16 may have an undulating shape such that the zones include concave and convex contours. In one embodiment, the massage device body may be shaped such that the zones include varying shapes with different surface areas of the rod, as described further below with regard to FIGS. 5A-B. For example, zone 67 and zone 69 may be a convex shape, whereas zone 68 may be a concave shape. In another example, zone 67 and zone 69 may include a handle 71 and handle 72, respectively. Further, zone 67 may include contour 73 and zone 69 may include contour 75. Both contours 73 and 75 may have pre-determined longitudinal distances and/or degree of curvatures. In one example, longitudinal distance and degree of curvature of contour 73 may be equal to the longitudinal distance and degree of curvature of contour 75. In another embodiment, zone 68, specifically contour 74, may have a longitudinal distance that may be greater than the longitudinal distance of contour 73 and the longitudinal distance of contour 75. The concave zones (e.g., zone 68) may be a solid plastic rod and the convex zone (e.g., zones 67 and 69) may have a hollow center. In another example, the concave zone 68 and convex zones 67 and 69 may be shaped from uniform density foam such that the convex zone 68 may not be hollow, as shown below with regard to FIGS. 5A-C.

For example, zone 68 may be a plastic rod including a top rod 76, bottom rod 77, and hollow portion 78. Top rod 76 may be positioned parallel to bottom rod 77. Additionally, top rod 76 may be disposed adjacent to bottom rod 77 via common wall 79 and common wall 80. In this way, a top rod 76 and bottom rod 77 may form a concave rod with a hollow portion 78.

Further, the third massage device 16 may have a vertical distance 70 such that the third massage device 16 may be positioned in bore 42 of second massage device 14. In one example, a third massage device may be used in combination with a massage wax formulated for maximum effectiveness for myofascial release. The massage wax may include coconut oil, shea butter, and beeswax.

Figures 2A, 2B:
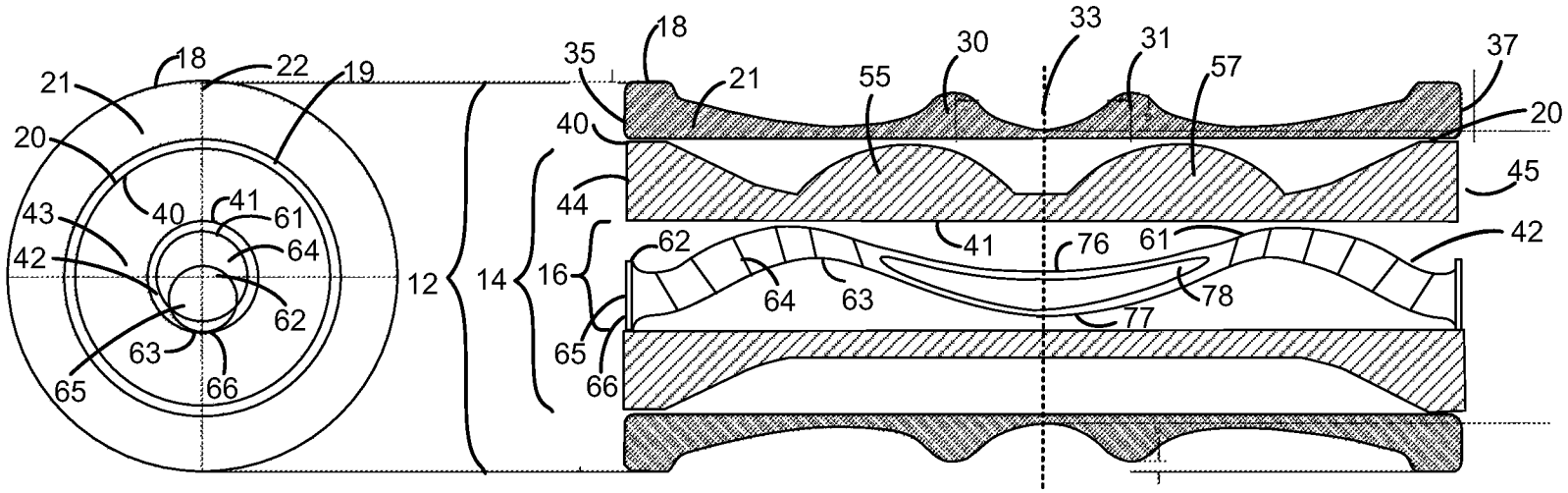
FIGS. 2A-B shows a schematic illustration of a three-part self-massage system assembly including three separate massage devices.

Now referring to FIG. 2A-B, another schematic diagram of the three-part self-massage system 10 assembly is shown. In one embodiment, the three massage devices, namely first massage device 12, second massage device 14, and third device 16, of the three-part self-massage system 10 may be removably coupled and assembled into one compact unit for storage and transport, described below with regard to FIGS. 1A-F. As such, a variety of massage techniques (e.g., myofascial release, deep tissue, and trigger point) may be self-administered by a user via one or more devices of the massage system 10.

Now referring to FIG. 2A, a first, second and third massage device may be assembled such that the massage devices form a compact massage system 10. The first massage device 12 may be the outermost massage device. In one example, the first massage device 12 includes an outer surface 18, inner surface 19, bore 20, and body 21. Additionally, the bore of the first massage device may be shaped such that a second massage device may be positioned in the bore of the first massage device. For example, the second massage device 14 may be positioned in bore 20 of the first massage device 12. In another example, the second massage device 14 may be positioned parallel to the first massage device 12.

In one embodiment, the second massage device 14 includes an outer surface 40, inner surface 41, bore 42 and body 43. The bore 42 of the second massage device 14 may be shaped such that the third massage device 16 may be positioned easily in the bore 42 of the second massage device 14. In an example, the third massage device 16 may be positioned parallel to the second massage device 14 and subsequently positioned parallel to the first massage device 12. The third massage device 16 may comprise a top surface 61, bottom surface 63, and body 64 of the device, body of a handle 65, bottom surface 66 of a handle, and top surface 62 of a handle. The cutting plane 22 defines the cross-section shown in FIG. 2B.

Now referring to FIG. 2B, an end view of the three-part self-massage system 10 is shown. A massage system 10 includes the first massage device 12, the second massage device 14, and the third massage device 16, as described above with reference to FIGS. 1A-F and 2A. As such, the second and third massage device may be removably coupled to the first massage device 12. Further, the third massage device 16 may be removably coupled to the second massage device 14 via insertion into the bore 42 of the second massage device 14, for example. The three-part self-massage system 10, for example, may be assembled such that the second massage device 14, and the third massage device 16 are disposed within the interior of bore 20 of first massage device 12. In this way, both the second and third massage devices may be included in the bore of the first massage device. In an additional example, massage system 10 may only include the second massage device positioned in bore 20 of the first massage device 12. In another example, massage system 10 may only include the third massage device 16 positioned in bore 42 of the second massage device.

Further, the first massage device 12 may include a plurality of projections, as described above with regard to FIG. 1A-B. For example, first massage device 12 may include projection 30 and projection 31. Additionally, outer edge 35 and outer edge 37 may also form one or more projections that may serve as handles provided for handling and manipulation by a user. The plurality of projections may be arranged annularly around the outer surface 18 of the massage device body 21. For example, projection 30, projection 31, outer edge 35 and outer edge 37 may be arranged annularly on the outer surface 18 of the massage device body 21. In one embodiment, projection 30 and 31 may be formed as a ridge with rounded edges. Projection 30 may be arranged parallel to projection 31 such that a contour may be formed between the parallel projections. In another example, the projections may be disposed perpendicular to the massage device body.

Similarly, the second massage device may include a plurality of projections. For example, the second massage device 14 includes projection 55 and projection 57. In one example, the second massage device 14 may include at least six annularly arranged projections. Specifically, in the cross-sectional view of FIG. 2B, only two projections are shown, wherein the projections 55 and 57 comprise a rounded shape. As such, the second massage device 14 may include at least two zones of three annularly arranged projections in each zone, as described further with regard to FIG. 4. In this example, unlike the projections in the first massage device 12, projection 55 and projection 57 may be shaped as annular knobs. In another example, the plurality of projections may include angled ridges and/or bumps. In yet another example, the plurality of projections may comprise a pyramid-like shape, such as projection 82, as shown in FIG. 1C. In one embodiment, the plurality of projections may vary in size. For example, projection 55 and projection 57 may be the same size; however additional projections (not shown) arranged annularly about surface 40 of the second massage device 14 may be larger or smaller in size than projection 55 and projection 57. It may be appreciated that the plurality of projections may include one or more and any combination of geometric shapes, sizes, and conformations disclosed. Further, the projections may be formed from non-uniform density foam. For example, projection 55 may be parallel to projection 57. As such, projection 55 may be formed with the same high density foam as projection 57. In another example, separate projection(s) (not shown) may be formed from different density foam (e.g., a lower density) compared to the density foam of projection 55 and projection 57.

In addition, the third massage device 16 may be cylindrical with the body 64 defined by the top surface 61 and bottom surface 63. In one embodiment, the massage device 16 may be shaped such that the massage device body 64 may comprise concave and convex contours. In another embodiment, one or more zones having concave contours (e.g., zone 67 and 69 in FIG. 1F) may be a solid plastic rod, and one or more zones having convex contours (e.g. zone 68 in FIG. 1F) may be a solid plastic rod having a hollow center. For example, zone 68 may be a plastic rod including the top rod 76, bottom rod 77, and hollow portion 78. Top rod 76 may be positioned parallel to bottom rod 77. In this way, top rod 76 and bottom rod 77 form a convex rod with the hollow portion 78. In another example, the convex rod may not have a hollow portion, as shown below with regard to FIGS. 5A-C.

When massage device 10 includes all three massage devices coupled to one another (e.g. when the massage system is assembled), the outer edges of the three massage devices may be parallel to each other. For example, outer edge 44 of the second massage device 14 and the handle body 65 of the third massage device may be disposed in the bore 20 of the first massage device 12 such that outer edge 44 and handle body 65 may be positioned parallel to outer edge 35. Since the interior surface of the first massage device 12 may not have projections, the second massage device 14 may be effortlessly inserted into the bore 20 of the first massage device 12. Additionally, the third massage device 16 may be easily inserted into the bore 42 of the second massage device 14 based on the interior surface of the second massage device.

Figure 3:
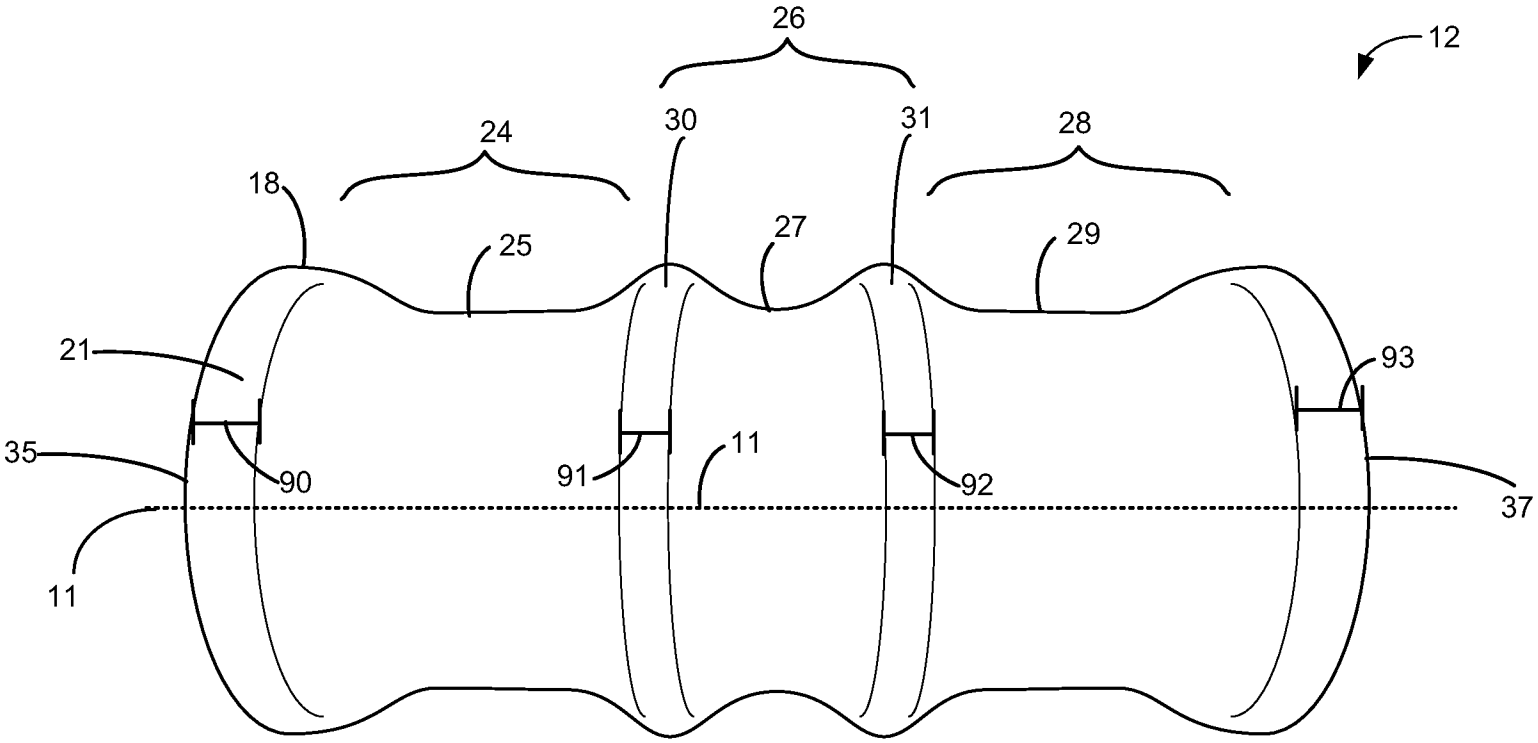
FIG. 3 shows a schematic illustration of a first massage device.

Now referring to FIG. 3, the first massage device 12 of a three-part self-massage system is shown, as described above with reference to FIGS. 1A-B. The first massage device 12 includes a massage device body 21 and bore 20. The bore 20 (not shown) may extend longitudinally along the longitudinal central axis 11 for the entire length of the body 21. The body 21 of the first massage device 12 may further comprise the outer surface 18 and may include a plurality of vertically extending projections, as described above in reference to FIG. 1A-B. In one example, the plurality of projections may be a plurality of ridge-shaped projects circumferentially around an outer surface of the first device. As such, outer surface 18 may be an uneven surface. Further, the body 21 of the massage device 12 may be formed from non-uniform hard density foam such that body 21 may be divided into zones based on the varying density foam. For example, the body 21 of a massage device 12 may have at least three zones including zone 24, zone 26, and zone 28. Zone 24 may be formed with low density foam as compared to the density of the foam in zone 28. As such, the varying densities of foam may allow the user to have more control over the pressure applied to the muscle and or soft tissue, thereby increasing effectiveness of the massage. Additionally, the body 21 may be shaped such that the zones include annularly arranged contours. Specifically, the body 21 including zone 24 and zone 28 may have a contour 25 and contour 29, respectively. In one example, contour 25 and contour 29 may be u-shaped contours. In another example, the contours may be a groove, indent, or valley of varying shapes. In addition, in one embodiment, the longitudinal distances of zone 24 and zone 28 are of equal length such that the surface areas of zone 24 and zone 28 are equal.

In another example, the zones may be defined based on the position of the plurality of projections. In this example, zone 26 includes projection 30 and projection 31. In one embodiment, projection 30 and projection 31 may each be formed as a ridge with rounded edges. In another embodiment, projection 30 and projection 31 may be formed with higher density foam than zone 28. In another embodiment, projection 30 and projection 31 may be formed with lower density foam than zone 24. As such, the foam density of projection 30 and projection 31 may be between the foam density of zone 28 and 24. In addition, the foam density of projection 30 and projection 31 may be substantially comparable and similar in density, shape, and size.

Projection 30 may be arranged parallel to projection 31 such that the projections form a contour 27 with a longitudinal distance along axis 11. In one example, contour 27 may be a groove, indent, or valley. In another example, contour 27 may be u-shaped. Additionally, the longitudinal distance of contour 27 may be less than the longitudinal distances of contours 25 and 29. Further, the projections may be arranged annularly around the outer surface of the massage device body 21. In another embodiment, projection 30 and projection 31 may be disposed perpendicular to the massage device body 21. In this way, the raised parallel projections in zone 26 may be formed such that the projections and/or ridges engage with contours of the musculature surrounding the human spine. Consequently, the projections may penetrate deep into the paraspinal muscles, as well as any muscles and soft tissue that require a deeper massage.

In one embodiment, zone 24 and zone 28 may have an outer edge 35 and outer edge 37, respectively. Based on the shape of the contours of zone 24 and zone 28, the outer edge 35 and outer edge 37 may also form an outer edge projection. In another example, the outer edge projections may be arranged annularly around the outer surface 18 of the massage device body 21. The projections may have varying longitudinal distances along axis 11. For example, outer edge 35 and outer edge 37 may have longitudinal distances 90 and 93, respectively. As such longitudinal distance 90 and longitudinal distance 93 may be equal longitudinal distances. Moreover, projection 30 may have a longitudinal distance 91 that may be equal to longitudinal distance 92 of projection 31. In one embodiment, longitudinal distances 90 and 93 may be greater than longitudinal distances 91 and 92. As a result, the surface areas of outer edge 35 and 37 (e.g. the outer edge projections) may be greater than the surface areas of projections 30 and 31.

Referring now to FIGS. 4A-B, the second massage device 14 of the three-part self-massage system 10 is shown, as described above with regard to FIG. 1C-D. The second massage device 14 comprises the massage device body 43, and a bore (not shown). The bore may extend longitudinally along the longitudinal axis 13 for the entire length of the body 43. Further, the second massage device 14 may have a vertical distance 60 such that the second massage device 14 may be positioned easily in the bore of first massage device 12. When the second massage device is coupled to the first massage device, longitudinal axis 13 of the second massage device is substantially the same as longitudinal axis 11. Said another way, when coupled together, the second massage device and the first massage device share a common central axis (e.g., axis 11). The body 43 of the second massage device 14 may also include the outer surface 40 and the inner surface 41 (not shown). Additionally, the outer surface 40 of the massage device body 43 may include a plurality of vertically extending projections, wherein the projections are asymmetric projections with different radial projections about the central axis. As such, outer surface 40 may be an uneven surface. Further, the body 43 of the massage device 14 may be formed from uniformly hard density foam.

In one embodiment, the body 43 may be divided into zones based on the position of the plurality of projections. For example, the body 43 of a massage device may have at least five zones including zone 48, zone 50, zone 52, zone 54, and zone 56. Zone 48, zone 50, and zone 52 may be formed with uniform density foam such as closed cell foam. Zone 54 and zone 56 may include annularly arranged projections having varying shapes and/or sizes, described below. In another embodiment, the massage device body 43 may be shaped such that the zones may comprise annularly arranged contours. Specifically, the body 43 including zone 48, zone 50, and zone 52 may have a contour 49, contour 51, and contour 53, respectively. In one example, contour 49, contour 51, and contour 53 may be u-shaped contours. In another example, contour 49, contour 51, and contour 53 may be a groove, indent, or valley of varying shapes and angles. In yet another example, the distances of zone 48 and zone 52 may be of equal length. In another example, the distance of zone 50 may be less than the distances of zone 48 and zone 52, such that the distance of the projection 55 and projection 57 are closer to one another than to the outer edges 44 and 45.

Further, the massage device zones may be based on the position of a plurality of projections. In one example, at least two of the zones contain at least three annularly arranged projections in each zone, wherein each projection in each zone may be arranged approximately 120 degrees from the next adjacent projection. In one embodiment, one or more of the annularly arranged projections may be separated by a ridge, contour and/or space such that one or more projections are separate and not a continuous projection. For example, a massage device 14 may have a zone 54 and zone 56. Zone 54 may include projections 55, 81 and 82. Similarly, zone 56 may include projections 57, 83, and 84. In one embodiment, each projection disposed in each zone may extend vertically to a specific distance from the outer surface of the massage device body 43. For example, projection 55 may have a vertical distance 58 that extends from massage body 43. Further, the plurality of projections may have a uniform vertical distance. In another example, the projections may be disposed perpendicular to the massage device body. In this example, projections 55, 57, 81, 82, 83, and 84 may be shaped as knobs (e.g., projection 55, projection 57, projection 81, and projection 84) and/or angled geometric shapes (e.g., projection 82 and projection 83). In one embodiment, the angled geometric shape of projection 82 and projection 83 may comprise a pentagon-like shape or a triangular configuration. For example, a first projection of the second massage device 14 may be rounded as compared to a second projection of the second device which may be more pointed than rounded. As a result, one or more projections having an angled geometric shape, including projection 82 and 83, may have a point, such as point 120 and point 122, wherein the point may contact a location on a user's body. In another example, the projections may include ridges and/or bumps.

The plurality of projections may also be formed with varying lengths and widths, such that one or more projections have unequal surface area. For example, projection 55 and projection 81 may generally comprise a similar shape, that is, an annular knob. However, projection 81 may have a longitudinal distance 85 and a width 86 that may be greater than a longitudinal distance (not shown) and a width (not shown) of projection 55. In contrast, projection 81 may have the same longitudinal distance 85 and width 86 of projection 84 including a longitudinal distance 87 and a width 88. As a result, based on the length and width of the projections, projection 81 and projection 84 may have the same surface area. As a result of the varying shapes and sizes of the plurality of projections, precise and varied massage techniques (e.g., myofascial release, deep tissue, and trigger point) may be self-administered by a user.

In sum, the plurality of projections may have different cross-sectional profiles from an end-view of the central axis 13 with at least a first projection having a rounded exterior peak (e.g., projection 55) and at least another second projection having a more pointed exterior peak (e.g., projection 82). In addition, in another example, the projections may be at different angular positions around the central axis 13. The projections may also include a third projection having a wider, in terms of angle about the central axis, and longer along a longitudinal axis, round peak than the first projection (e.g., projection 81). In another example, the first, second, and third peaks may be 120 degrees apart from one another around the central axis. There may be a total of exactly 5 of said projections with all five of said projection spaced away from each of two ends of the foam roller, the more pointed exterior peak being in a middle of the foam roller.

In one embodiment, the projections may be fabricated from non-uniform density foam. For example, at least one projection in a zone may be higher density foam than at least one other projection in the same zone. In another example, at least one projection in a zone may be low density foam compared to at least one other projection in the same zone. Additionally, a projection in a first zone may be formed from the same density foam as a corresponding projection in a second zone. For example, projection 55 of zone 54 may be parallel to projection 57 of zone 56. As such, projection 55 may be formed with the same high density foam as projection 57. In another example, projection 81 may be formed from low density foam as compared to projection 55 but formed from higher density foam as compared to projection 82. Further, projection 82 may be formed from low density foam compared to projections 55 and 81. In another example, projection 55 and projection 57 may be corresponding projections such that projection 55 and projection 57 are formed from the same density foam. In an additional example, projection 81 and projection 84 may be corresponding projections such that projection 81 and projection 84 are formed from the same density foam. In yet another example, projection 82 and projection 83 may be corresponding projections such that projection 82 and projection 83 may be formed form the same density foam. Further, the corresponding projections may be positioned parallel to each other along the axis 33, as shown in FIG. 1C-D.

In an embodiment, the massage device body 43 may be shaped such that one or more zones include annularly arranged contours. The zones with contours may be defined based on the position of the projections, as well as the outer edge(s) of the massage device 14. For example, projection 55 may be arranged parallel to projection 57 such that the projections form a contour 51 of zone 50. Further, an outer edge of the massage device may include a projection that may be arranged annularly around the outer surface of the massage device body 43. For example, zone 48 and zone 52 may have an outer edge 44 and outer edge 45, respectively. Based on the shape of the contours of zone 48 and zone 52, the outer edge 44 and outer edge 45 may also form outer edge projections. In another example, outer edge 44 and outer edge 45 may be positioned parallel to projections 55, 57, 81, 82, 83, and 84. As such, outer edge 44 and outer edge 45 may be disposed perpendicular to zones 48 and 52 and axis 13.

Now referring to FIG. 4B, a cut-out perspective of zone 54 of the second massage device 14 including a plurality of projections is shown. Said another way, FIG. 4B shows a view of projections of zone 54 if zone 54 was cut out from the second massage device 14 and linearized so that projection 55, projection 81 and projection 82 may be aligned in series. In this example, zone 54 includes a plurality of projections (e.g., projection 55, projection 81, and projection 82). Furthermore, zone 56, parallel to and at a specific distance from zone 54, may be substantially similar compared to zone 54 in number, arrangement, and conformation of corresponding projection 57, projection 84, and projection 83.

In one embodiment, zone 54 may include at least three annularly arranged projections. Specifically, zone 54 may comprise projection 55, projection 81, and projection 82. In an example, the projections comprise of rounded knob-like shapes (e.g., projection 55 and projection 81), and/or angled, geometric shapes, including triangular, pyramidal or pentagonal shapes (e.g., projection 82 having the point 120). In additional examples, the projections in any zone may be shaped as triangle-shaped projections, pyramids, knobs, ridges, or bumps. For example, a first and/or second projection of the second massage device 14 (e.g., projections 55 and 81) may be rounded as compared to a third projection of the second device (e.g., projection 82) which may be more pointed than rounded.

In one example, the projections may have equal vertical distances such that each projection may have a vertical distance of height 126. In contrast, in another embodiment, a length of projection 55, projection 82 and projection 81 may vary. In this example, a length 128 of projection 55 may be less than a width 86 of adjacent projection 81 and a length 124 of adjacent projection 82. In another example, length 124 of projection 82 may be less than width 86 of projection 81. Therefore, projection 81 having the width 86 may be greater than the lengths of the other projections.

Now referring to FIGS. 5A-C, a schematic design of a massage device is shown. Specifically, a third massage device including zones with varying surface areas are shown. The third massage device may be a solid rod formed from hard plastic. Further, the third massage device may be shaped with concave and convex working surface(s) including varying surface areas of hard plastic.

FIG. 5A shows a schematic design of the third massage device 16. Third massage device 16 may be cylindrical with body 64 defined by top surface 61, bottom surface 63, and handles 71 and 72. The massage device body 64 may be shaped such that the zones include concave and convex contours. For example, zone 67 and zone 69 may comprise a convex shape, whereas zone 68 may comprise a concave shape. Further, zone 67 and zone 69 may have a contour 73 and contour 75, respectively, each contour having a predetermined longitudinal distance along the axis 11. In one example, the longitudinal distance of contour 73 may be equal to the longitudinal distance of contour 75. In another example, the longitudinal distance of contour 74 may be greater than the longitudinal distance of contour 73 and/or the longitudinal distance of contour 75. The third massage device 16 may have a vertical distance 70 such that the third massage device 16 may be positioned and stored easily and accessibly in bore 42 of the second massage device 14.

Now referring to FIG. 5B, a cross-section of the third massage device is shown. In addition, several end-views of the third massage device 16 are shown. A cutting plane 94 defines a cross-section 106. The zone 67 may include a cutting plane 102 which defines an end-view of a contour 114. The handle 71 includes a cutting plane 104 which defines an end-view of a contour 116. Additionally, zone 68 includes a cutting plane 100. The cutting plane 100 defines an end-view of contour 112. Zone 69 includes a cutting plane 98 that defines an end-view of a contour 110. The handle 72 includes a cutting plane 96 which defines an end-view of a contour 108. As such, the third massage device 16 may have zones that include a plurality of contours and/or valleys of varying shapes and surface areas. For example, zone 67 may have the contour 114, wherein the contour 114 may have a greater surface area than the contour 116. In another example, zone 69 may have the contour 110, such that contour 110 may have a greater surface area than the contour 108. In an additional example, contour 108 may have the same shape and surface area as contour 116. Contour 110, for example, may have the same shape and surface area as contour 114. However, zone 68 may include contour 112 that may not be the same shape as contours 108, 110, 114, and/or 116. Further, contour 112 may have a surface area less than the surface area of contours 108, 110, 114, and/or 116. In another example, the contours may be irregular in shape or conformation such that the contours are asymmetrical.

Now referring to FIG. 5C, a representative picture of the third massage device 16 is shown. Third massage device 16 may be generally cylindrical in shape with a plurality of zones, and includes handles 71 and 72. The massage device body may be shaped such that the zones include concave and convex contours. For example, zone 67 and zone 69 may be a convex shape, whereas zone 68 may be a concave shape. Further, zone 67 and zone 69 may have a contour 75 and contour 73 with pre-determined longitudinal distances, respectively. Zone 68 may include a contour 74 with a pre-determined longitudinal distance. In one example, the contours may be irregular in shape and conformation such that the contours are not symmetrical. In addition, the longitudinal distances for contour 75 and contour 73 may be equal. In an alternative example, the longitudinal distances for contour 75 and contour 73 may not be equal. By providing a plurality of zones having the particular and/or dissimilar contours, it may enable a user to self-administer desirable massage techniques, including myofascial release therapy.

Now referring to FIG. 6A-B, a schematic diagram of the three-part self-massage system 10 including a partial assembly with two massage devices, shown in FIG. 6A and, a partial assembly with three massage devices, shown in FIG. 6B, as described above with regard to FIGS. 1A-D and FIGS. 2A-B. As such, the massage devices may be removably coupled and assembled into one compact unit for storage.

Now referring to FIG. 6A, a partial assembly of two massage devices of a three-part massage system is shown first massage device 12 of massage system 10 includes the massage device body 21 and bore 20. The bore 20 may extend longitudinally along the longitudinal central axis 11 for the entire length of the body 21. The body 21 of the first massage device 12 may include an outer surface 18. In one embodiment, the body 21 may comprise a plurality of zones (e.g. zone 24 and zone 26), wherein the zones may include a plurality of vertically extending projections having a certain vertical height relative to the central axis 11 (e.g., projection 30 and projection 31), as well as a plurality of annularly arranged contours (e.g. contour 25). In one example, the plurality of projections may be a plurality of ridge-shaped projects circumferentially around an outer surface of the first device. Inner surface 19 may have no projections, thereby may have a level surface. In this example, the body 21 including zone 24 may have a contour 25. In another example, contour 25 may be a u-shaped contour.

Furthermore, the second massage device 14 may include the massage device body 43, outer surface 40, and outer edge 44. Further, a second massage device 14 may also include zone 48 and zone 54. As such, zone 54 may include projections 55, 81, and 82 arranged annularly on the outer surface 40 of the massage device body 43. The aforementioned projections may be asymmetric projections with different radial projections about the central axis 11. Moreover, each projection 55, 81, and 82 may be arranged 120 degrees from the adjacent projection about the massage device body 43.

The second massage device 14 may be disposed in an interior portion of the first massage device. In this example, the second massage device 14 is partially disposed in the bore 20 of the first massage device 12. Therefore, a second massage device may be formed such that the length and width of the second massage device may be arranged substantially within the bore 20 of the first massage device 12. For example, the second massage device 14 has the distance 60 that may be equivalent to the distance 39 of bore 20 of the first massage device 12. Further, the outer edge 44 of the second massage device 14 may be disposed in the bore 20 of the first massage device 12 such that outer edge 44 may be positioned parallel to outer edge 35. Since the interior surface of the first massage device 12 may not have projections, the second massage device may be easily inserted into and removed from the bore of the first massage device.

Now referring to FIG. 6B, a partial assembly of three massage devices of the three-part massage system 10 is shown. A massage system 10 includes a first massage device 12, a second massage device 14, and a third massage device 16. In this embodiment, the bore 20 and the bore 42 may extend longitudinally along the longitudinal central axis 11 for the entire length of the body 21 and body 44, respectively. In this way, longitudinal axis 13 may be the substantially the same as the common longitudinal axis 11 when the second massage device is disposed in the interior of the first massage device. In this example, the second massage device 14 may have a body 43 that is partially disposed in the bore 20 of the first massage device 12. The third massage device may be disposed in the interior of the second massage device. In this example, the third massage device 16 may have a body 64 that is partially disposed in the bore 42 of the second massage device 14. Further, the outer edge 44 of the second massage device 14 may be disposed in the bore 20 of a first massage device 12 such that outer edge 44 may be positioned parallel to outer edge 35. Since the interior surface of the first and second massage devices do not have projections, the second and third massage devices may be easily inserted into the bore of the first and/or second massage device, respectively. Additionally, the second and third massage devices may be easily removed from the bore of the first and second massage devices.

The technical effect of the massage system described here may enable any user to self-administer therapeutic massage techniques (e.g., myofascial release, deep tissue, and trigger point) easily and economically. The massage system 10 having the first and second massage roller devices and the third solid rod-like device allows the application of shear compression and/or tension to a user's muscles in various directions, or by skin rolling. As a result, each of the three massage devices 12, 14 and 16 may be formed and/or shaped in order to perform a variety of specific massage techniques. Furthermore, the provision of appropriately sized bores in the first and second massage devices 12 and 14 to fit the second and third massage devices within the first massage device permits convenience in storage and transport.

Therefore, in one embodiment, a massage system is provided comprising a first massage device removably coupled to a second massage device and a second massage device removably coupled to a third massage device. In an example, the second and third massage devices are disposed within a bore of the first massage device, thus the second device may have a common central longitudinal axis when coupled with the first device. In another example, the second device may comprise asymmetric projections with different radial projections about the central axis. Specifically, a first projection of the second device may be rounded as compared to a second projection of the second device which may be more pointed than rounded. Furthermore, the second massage device may include a second outer surface, wherein the second outer surface is formed from uniform density foam.

In another embodiment, the first device may have a plurality of ridged-shape projections circumferentially around an outer surface of the first device. Furthermore, in an example, the first massage device includes a first outer surface, wherein the first outer surface includes a non-uniform density foam such as closed cell foam. In addition, the outer surface may include three zones separated by parallel ridges, wherein the parallel ridges are arranged annularly around an outer surface. In this way, the first device may have a total of four ridges. In another example, the three zones may be of varying densities of foam separated by the annular parallel ridges. Moreover, the bore of the first massage device may include an inner surface, wherein the inner surface forms a hard hollow spine.

In addition, the third massage device may include a solid undulating rod at least along a partial length of the third device. In one example, the third massage device may also include two ergonomically shaped handles and at least two zones.

In an alternative embodiment, a foam roller is provided, comprising a plurality of ridges. In one example, the foam roller may be generally cylindrically shaped with a hollow inner cylinder formed by an inner wall of the foam roller. Also, the hollow inner cylinder may have a common central axis with central axes of the plurality of ridges, where the ridges are positioned along the central axis with different distances between respective peaks of the ridges. In another example, hollow inner cylinder may have no components of the foam roller and may be shaped and sized to accommodate and receive a smaller diameter foam roller therein without any obstructions. In one embodiment, the outer surface is provided with varying foam along the central axis.

In an embodiment, a foam roller is provided comprising a plurality of projections, where the foam roller is generally cylindrically shaped with a hollow inner cylinder formed by an inner wall of the foam roller. In one example, the projections may have different cross-sectional profiles from an end-view of the central axis with at least a first projection having a rounded exterior peak and at least another second projection having a more pointed exterior peak. In addition, in another example, the projections may be at different angular positions around the central axis. The projections may also include a third projection having a wider, in terms of angle about the central axis, and longer along a longitudinal axis, round peak than the first projection. In another example, the first, second, and third peaks may be 120 degrees apart from one another around the central axis. There may be a total of exactly 5 of said projections with all five of said projection spaced away from each of two ends of the foam roller, the more pointed exterior peak being in a middle of the foam roller.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A massage system, comprising:

a first massage device removably coupled to a second massage device, the first massage device comprising a plurality of ridges, where each ridge of the plurality of ridges extends continuously around a circumference of the first massage device; and the second massage device being removably coupled to a third massage device, the second massage device having a smaller diameter than the first massage device, and the second massage device including a plurality of projections annularly disposed around a circumference of the second massage device, wherein the second and third massage devices are disposed within a bore of the first massage device, the second massage device having a common central longitudinal axis with the first massage device when coupled with the first massage device, and where the third massage device is removably coupled within a bore of the second massage device, the third massage device being an undulating rod that is asymmetric about a length of the undulating rod, wherein the undulating rod comprises a first handle and a second handle formed into the undulating rod and positioned at either end of the undulating rod, the first and second handles each positioned adjacent portions of the undulating rod having diameters that are greater than diameters of the first and second handles, where only a portion of a circumference of outer edges of the third massage device contacts an inner surface of the second massage device, and where only a bottom of the first handle and only a bottom of the second handle contact the inner surface of the second massage device when the third massage device is removably coupled within the second massage device.

2. The massage system of claim 1, wherein the plurality of projections of the second massage device is asymmetric projections with different cross-sectional profiles about the common central longitudinal axis.

3. The massage system of claim 2, wherein a cross-sectional profile of a first projection of the plurality of projections of the second massage device is more rounded as compared to a cross-sectional profile of a second projection of the plurality of projections of the second massage device, and where the cross-sectional profile of the second projection of the plurality of projections of the second massage device is pointed.

4. The massage system of claim 3, wherein a third projection of the plurality of projections of the second massage device has a cross-sectional profile that is more rounded than the cross-sectional profile of the second projection of the plurality of projections of the second massage device, and wherein a longitudinal distance and a width of the third projection of the plurality of projections of the second massage device is greater than a longitudinal distance and a width of the first projection of the plurality of projections of the second massage device, and wherein the second projection is circumferentially positioned between the first projection and the third projection.

5. The massage system of claim 1, wherein the plurality of projections of the second massage device is positioned between a first outer edge and a second outer edge of the second massage device, where the first outer edge and the second outer edge are at opposite ends of the second massage device.

6. The massage system of claim 5, wherein the first outer edge and the second outer edge of the second massage device each have heights greater than the plurality of projections of the second massage device.

7. The massage system of claim 6, wherein a valley is formed between the plurality of projections of the second massage device.

8. The massage system of claim 7, wherein the valley formed between the plurality of projections of the second massage device is aligned with a valley formed between two consecutive ridges of the plurality of ridges of the first massage device when the second massage device is removably coupled within the first massage device.

9. The massage system of claim 8, wherein the third massage device includes three contours, and where a center of a second contour of the third massage device that is positioned between a first contour and a third contour of the third massage device is aligned with the valley formed between the two ridges of the plurality of ridges of the first massage device and with the valley formed between the plurality of projections of the second massage device when the third massage device is removably coupled within the second massage device and when the second massage device is removably coupled within the first massage device.

10. The massage system of claim 1, wherein the second massage device includes an outer surface, and wherein the outer surface is formed from uniform density foam.

11. The massage system of claim 1, wherein the plurality of ridges of the first massage device includes a first outer edge and a second outer edge that are positioned on opposite ends of the first massage device, and where a remainder of the plurality of ridges is positioned along a length of the first massage device between the first outer edge and the second outer edge.

12. The massage system of claim 11, wherein the first outer edge and the second outer edge of the first massage device are aligned with a first outer edge and a second outer edge of the second massage device when the second massage device is removably coupled within the first massage device, and wherein the first outer edge and the second outer edge of the first massage device each have a height that is greater than a height of the plurality of ridges of the first massage device, and wherein the first massage device has a total of four ridges.

13. The massage system of claim 1, wherein a middle region of the undulating rod has a non-repeating shape, the middle region of the undulating rod spanning between the portions of the undulating rod that are adjacent to the first and second handles and having diameters greater than the diameters of the first and second handles.

14. A first foam roller, comprising:

a plurality of ridges that extends continuously around a circumference of the first foam roller, where the first foam roller is generally cylindrically shaped with a hollow inner cylinder formed by an inner wall of the first foam roller, the hollow inner cylinder having a central axis, where the plurality of ridges is positioned along the central axis with different distances between respective peaks of the plurality of ridges, where a smaller diameter second foam roller is removably coupled within the hollow inner cylinder of the first foam roller, the smaller diameter second foam roller including a plurality of annularly disposed projections, and where an undulating rod is removably coupled within a bore of the smaller diameter second foam roller, the undulating rod including at least one contour that is convex relative to a body of the undulating rod and at least one contour that is concave relative to the body of the undulating rod, where each of the at least one convex contour and where each of the at least one concave contour forms a different zone of the undulating rod, where the undulating rod is asymmetric about a length of the undulating rod, where a longitudinal centerline of the undulating rod is centered at diameters of both a first end of the undulating rod and a second end of the undulating rod, and where the longitudinal centerline of the undulating rod is offset at a center diameter of the undulating rod, and where the center diameter is non-repeating and is less than the diameters of the first and second ends, and where the longitudinal centerline of the undulating rod is offset at diameters of the undulating rod positioned between the center diameter of the undulating rod and the first and second ends of the undulating rod, where different proportions of the undulating rod are on either side of the longitudinal centerline of the undulating rod at the center diameter of the undulating rod compared to proportions of the undulating rod on either side of the longitudinal centerline of the undulating rod at the diameters of the undulating rod positioned between the center diameter of the undulating rod and the first and second ends of the undulating rod.

15. The first foam roller of claim 14, wherein the hollow inner cylinder has no components of the first foam roller and is shaped and sized to accommodate and receive the smaller diameter second foam roller therein without any obstructions, and wherein the plurality of annularly disposed projections of the smaller diameter second foam roller is asymmetric about a central axis of the smaller diameter second foam roller.

16. A first foam roller, comprising:

a plurality of ridges that extends continuously around a circumference of the first foam roller, where a smaller diameter second foam roller is removably coupled within the first foam roller, the smaller diameter second foam roller including a plurality of projections, and where the smaller diameter second foam roller is generally cylindrically shaped with a hollow inner cylinder formed by an inner wall of the smaller diameter second foam roller, where at least two of the plurality of projections have different cross-sectional profiles from an end-view of a central axis of the first foam roller, with at least a first projection having a rounded exterior peak and at least a second projection having a more pointed exterior peak than the first projection, where an undulating rod is removably coupled within the smaller diameter second foam roller, the undulating rod being asymmetric about a length of the undulating rod, wherein a first end of the undulating rod having a first diameter is adjacent a first portion of the undulating rod having a second diameter, where the second diameter is different than the first diameter, where a longitudinal centerline of the undulating rod is centered at the first end of the undulating rod having the first diameter, where the longitudinal centerline is offset at the first portion of the undulating rod having the second diameter, where the longitudinal centerline of the undulating rod is centered at a second end of the undulating rod that is opposite the first end, where a center portion of the undulating rod is maximally offset from the longitudinal centerline of the undulating rod, where said maximal offset is not repeated along the length of the undulating rod, where the undulating rod further includes a third portion that is adjacent to a second portion of the undulating rod, the third portion having a third diameter, and wherein the third diameter is different than both the first diameter and the second diameter, where the longitudinal centerline of the undulating rod is offset at the third diameter of the undulating rod, and where proportions of the undulating rod on either side of the longitudinal centerline of the undulating rod at the third diameter of the undulating rod are different than proportions of the undulating rod on either side of the longitudinal centerline of the undulating rod at the second diameter of the undulating rod.

* * * * *